US006199489B1

(12) United States Patent
Tsai

(10) Patent No.: US 6,199,489 B1
(45) Date of Patent: Mar. 13, 2001

(54) FOLDING TABLE

(75) Inventor: Ting-Sheng Tsai, Kaohsiung Hsien (TW)

(73) Assignee: Teamnox International Co., Ltd., Taipei (TW)

( * ) Notice: Subject to any disclaimer, the term of this patent is extended or adjusted under 35 U.S.C. 154(b) by 0 days.

(21) Appl. No.: 09/479,220

(22) Filed: Jan. 7, 2000

(51) Int. Cl.[7] ..... A47B 03/06

(52) U.S. Cl. ..... 108/115; 108/154; 108/157.1; 108/34

(58) Field of Search ..... 108/163, 115, 108/34, 68, 157.1, 157.18, 153.1, 151, 135, 159.12, 158.12, 158.13, 65, 67, 69, 166

(56) References Cited

U.S. PATENT DOCUMENTS 827,834 * 8/1906 Westby ..... 108/153.1 X
1,295,194 * 2/1919 Parelius ..... 108/34 X
1,432,959 * 10/1922 Brady ..... 108/159.12 X
1,520,520 * 12/1924 Thomason ..... 108/153.1 X

* cited by examiner

*Primary Examiner*—Janet M. Wilkens
*Assistant Examiner*—Michael J. Fisher
(74) *Attorney, Agent, or Firm*—Rosenberg, Klein & Lee

(57) ABSTRACT

A folding table is provided that includes four legs, a top and two side panels. Two lateral tubes are fixed to those legs and the top is comprised of multiple planks connected with ropes. Locking bolts are respectively provided in the vicinity of each end of each of the lateral tubes. A pin protrudes from below each end of two of the outermost planks of the top. A step is provided in each side panel, and a connection hole and a locking hole are each provided in the vicinity of each end of each step. The connection hole is provided to secure the side panel to the legs and the locking hole is provided to receive a corresponding pin from a respective outermost plank to lock the planks to the side panel, so that the ends of each plank of the top are all butted with the step of the side panels.

1 Claim, 4 Drawing Sheets

FOLDING TABLE

BACKGROUND OF THE INVENTION

1. Field of the Invention

The present invention relates to a folding table, and more particularly to a modified structure of a folding table made of light metal (e.g., aluminum alloy).

2. Description of the Prior Art

As illustrated in FIG. 3, a prior art folding table made of light metal (e.g. aluminum alloy) is comprised of four legs (1) and a top (2). The legs (1) are connected to two lateral tubes (11) and a locking hole (111) is provided near both ends of each lateral tube (11), while the top (2) is made of a plurality of planks (21), connecting rope (22) and two edge covers (23). Both sides of the aluminum extruded planks (say, 12 planks) of the top (2) rest on the two lateral tubes (11) and are held together with ropes (say, 4 ropes) (22). The ends of each plank (21) are locked in position by the edge covers (23). A C-type snap (211) is provided below both ends of the outermost two planks (21) of the top (2) and a pin (212) is provided in the snap (211). When assembled, the snaps (211) respectively lock to both ends of the lateral tube (11) extending between the legs (1), with the pins (211) respectively inserted into corresponding locking holes (111), as illustrated in FIG. 4. However, in practical use, only the outermost planks (21) of the top (2) are locked to the lateral tubes (11), all other planks (21) of the top (2) are not. The user may easily either push away the planks (21) or shake the top (2), to cause objects on the top (2) to be knocked over. Since both ends of the plank are exposed, the edge covers (23) are required to protect the user from being cut by the sharp edges of the planks (21). That arrangement requires more effort by the user to install the edge covers (23). Furthermore, it is a difficult operation to install the connection ropes (22), since the planks (21) are of a closed type.

SUMMARY OF THE INVENTION

The primary objective of the present invention is to provide a folding table that permits easy assembly, is convenient in operation and has a stable top. It is essentially comprised of four legs, a top and two side panels, wherein, two lateral tubes are locked to the legs. The planks are held together with ropes, while a locking bolt is provided near each end of the lateral tubes and a downwardly protruding pin is provided below each end of each of two outermost planks. Each side panel is provided with a step and one connection hole and one locking hole provided near both ends of the step, so that both panels are held in position by the locking bolts inserted into the connection holes. The pins respectively provided on the two outermost planks of the top are inserted into the locking holes of the side panel, and both ends of each plank of the top are butted against the steps of the side panels.

DETAILED DESCRIPTION OF THE PREFERRED EMBODIMENT

Figure 1:
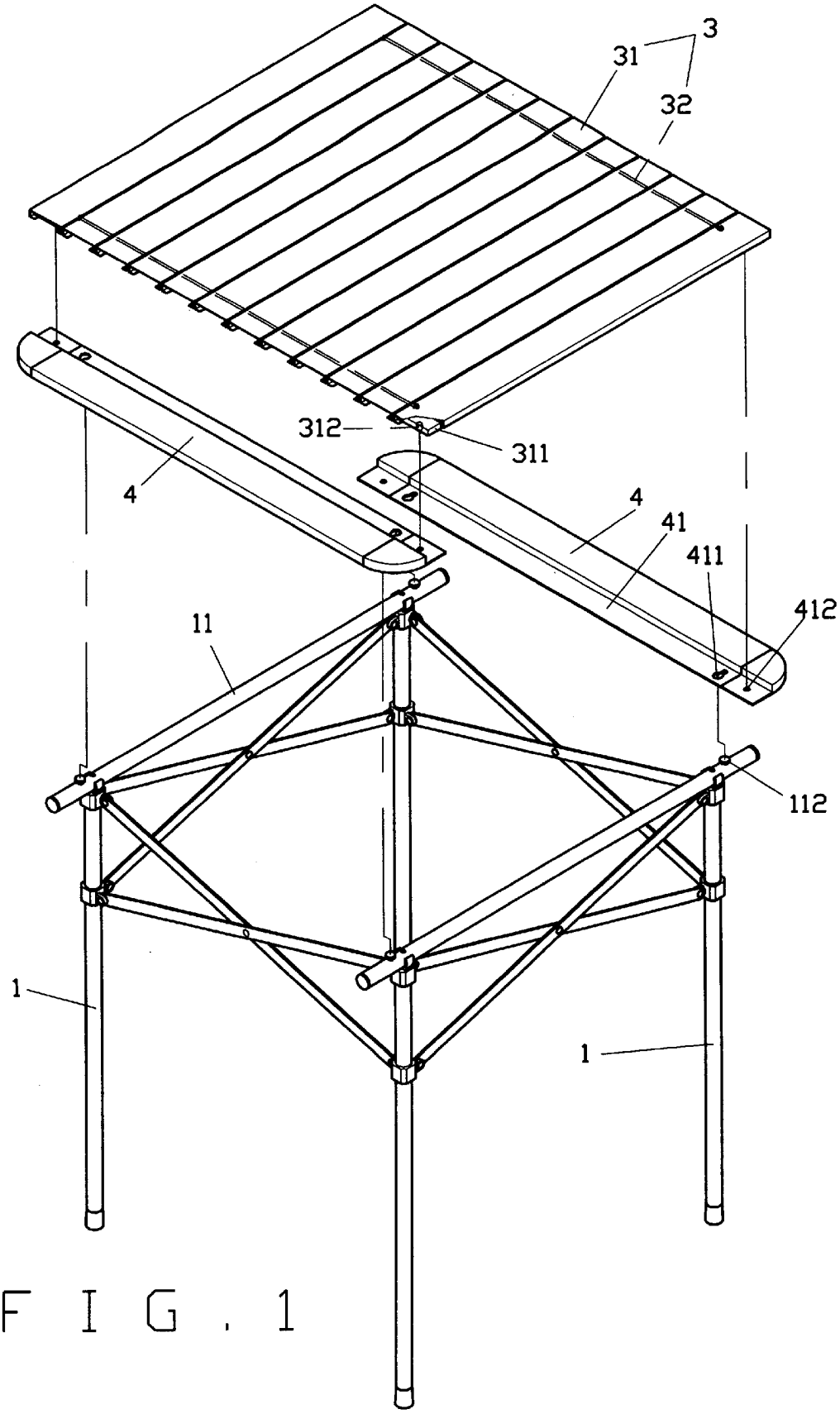
FIG. 1 is an exploded view of a preferred embodiment of the present invention.
Figure 2:
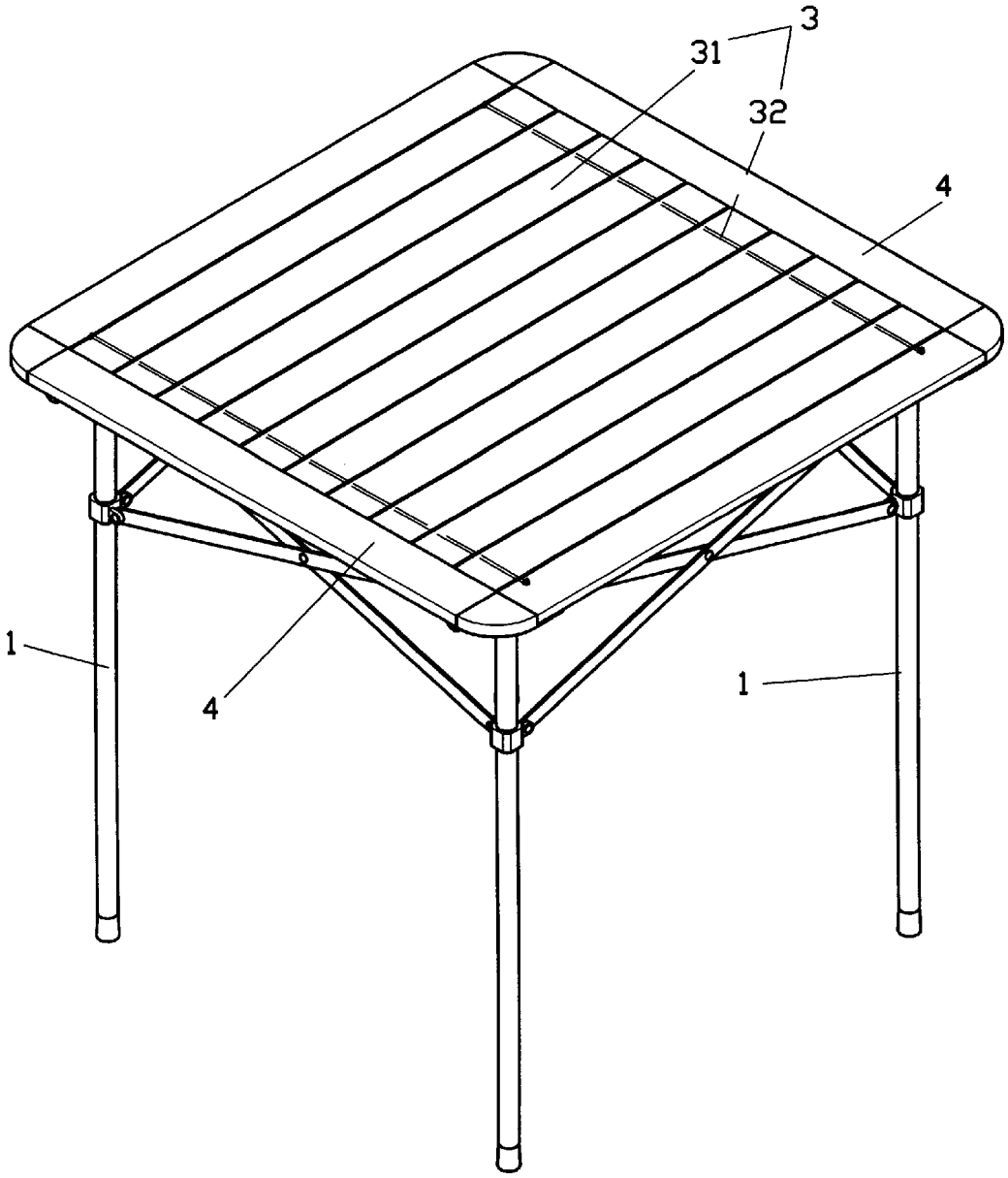
FIG. 2 is a perspective view of the assembly of the preferred embodiment of he present invention.
Figure 3:
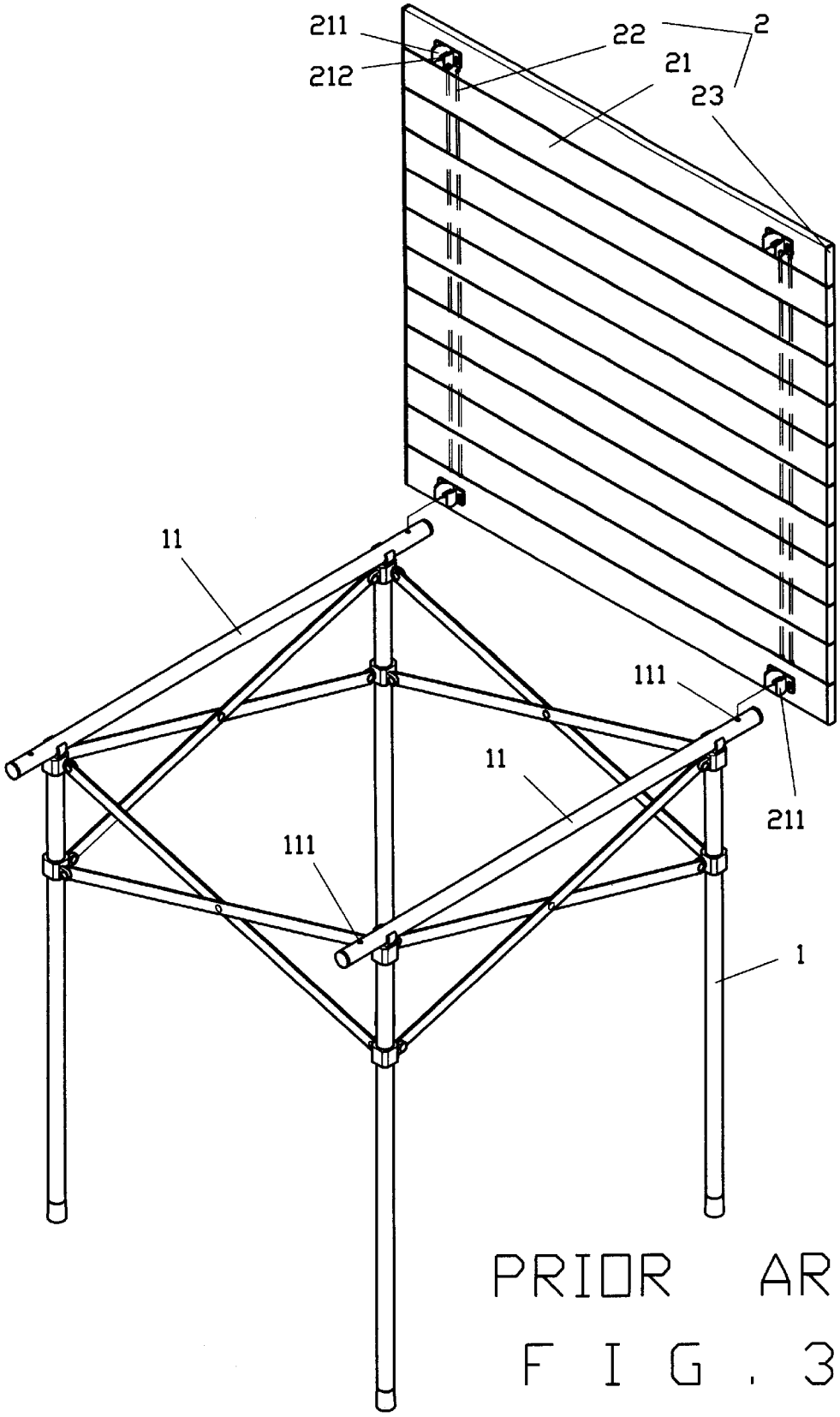
PRIOR ART FIG. 3
FIG. 3 is an exploded view of a prior art table.
Figure 4:
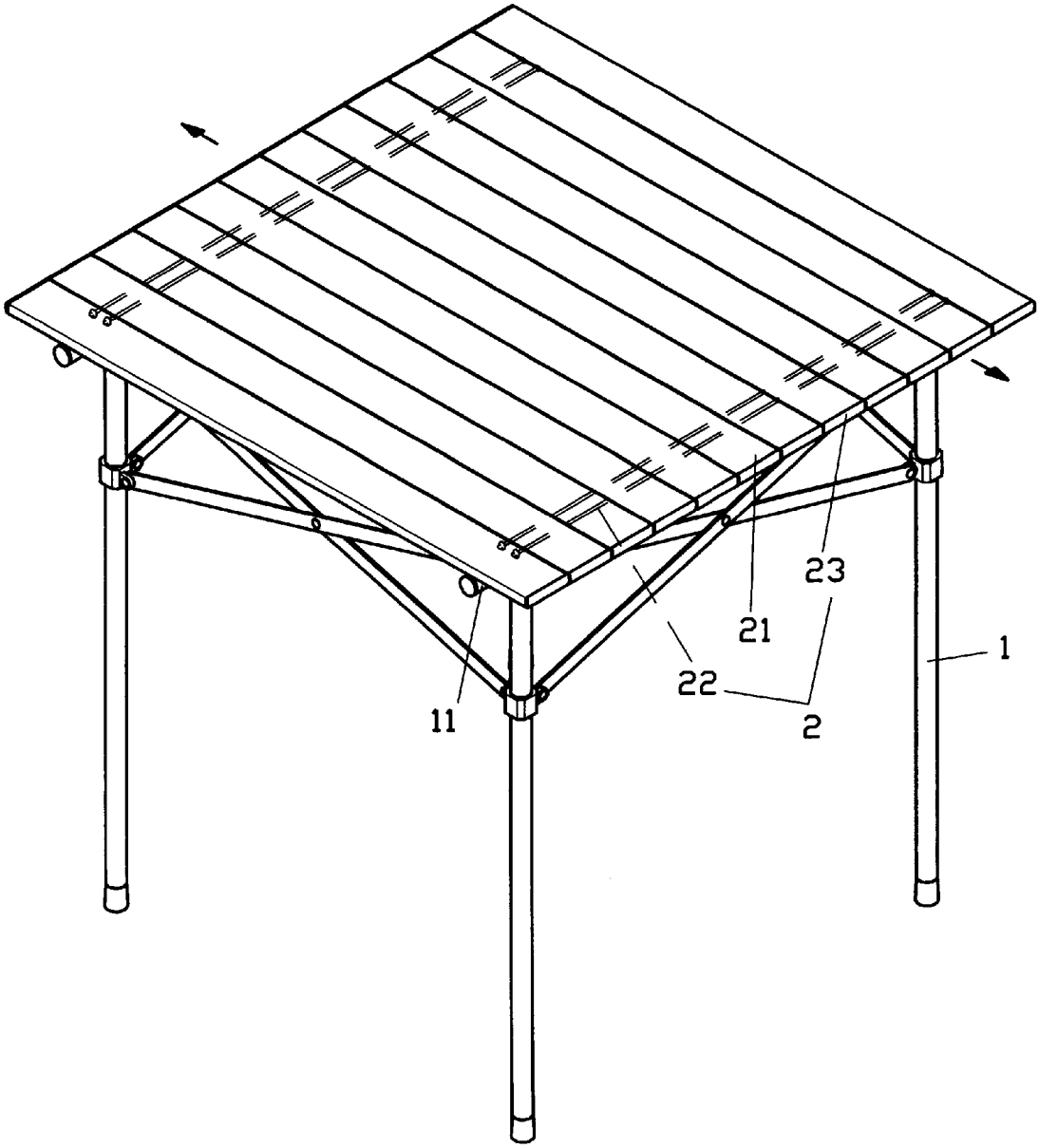
PRIOR ART FIG. 4
FIG. 4 is a perspective view of the assembly of the prior art table.

Referring to FIGS. 1 and 2, a preferred embodiment of the present invention is comprised of our legs (1), a top (3) and two side panels (4). Wherein, two lateral tubes (11) are locked to the legs (1). A locking bolt (112) is respectively provided near each end of each lateral tube (11). The outer diameter for the upper part is greater than that for the lower part of the bolt (112). The top (3) is made of a plurality of planks (31) and connecting ropes (32). Wherein, said planks (31) are each made of an aluminum extrusion with a slotted bottom. The ropes (32) (say, two ropes) respectively penetrate all of the planks (31) on both sides, and a caulking piece (311) is respectively incorporated below both ends of those two outermost planks (31) of the top (3), with a pin (312) protruding downward from each caulking piece (311). A step (411) is formed in each of the two side panels (4), and one connection hole (411) and one locking hole (412) are provided near each end of the step (41). Wherein, the connection hole (411) is comprised of a larger opening portion and a smaller opening portion.

In assembling the table, the larger opening portion of the connection hole (411) on the step (41) of each end of both side panels (4) is respectively penetrated by the upper part of the locking bolt (112) of a corresponding leg (1). Each side panel (4) is pushed laterally so that the smaller opening portion of the connection hole (411) receives the lower part of the locking bolt (112) therein. Both panels (4) are thereby fixed to the legs (1) and extending in a direction transverse to the direction of both lateral tubes (11), in parallel. Then, both pins (312) at both ends of each of two outermost planks (31) are inserted into the locking holes (412) of the side panels (4) to complete the assembly, as illustrated in FIG. 2. Wherein, both ends of each plank (31) of the top (3) are respectively butted against the steps (41) of the side panels (4). Both ends of each plank (31) are fully covered by the side panels (4) to prevent their accidental dislocation by the user, thus an object placed on the top (3) will be secure. Furthermore, the base of each plank (31) is slotted to facilitate their being bound together with a rope (32), so that edge covers, as used in the prior art, are not required.

I claim:

1. A folding table comprising:

a base having four legs with a pair of lateral tubes respectively extending longitudinally between two laterally spaced pairs of said legs, each of said lateral tubes having a pair of locking bolts respectively extending from an area adjacent opposing ends thereof, each said locking bolt having an upper part and a lower part, said upper part being larger than said lower part;

a top formed by a plurality of extruded aluminum planks joined together in side-by-side relationship by a plurality of connection ropes threaded through said plurality of planks, each of said planks having a slotted opening formed in a lower side thereof and extending between opposing ends of said plank;

a pair of side panels coupled to said base, each of said side panels having a step formed by a recessed flange extending between opposing ends of said side panel for supporting a respective end portion of said plurality of planks thereon, said recessed flange having a pair of connection holes and a pair of locking holes respectively formed therein adjacent opposing ends thereof, each of said connection holes having a large opening portion and a small opening portion, each of said side panels being secured to a respective pair of said locking bolts by passing said larger part of each locking bolt through said large opening portion of a corresponding one of said connection holes and displacing said side panel to engage said lower part of each said locking bolt with a respective small opening portion of said corresponding connection hole; and, a plurality of caulking members respectively mounted in opposing end portions of a pair of endmost planks of said top, each of said plurality of caulking members having a pin extending downwardly therefrom for engagement with a corresponding locking hole of a respective side panel recessed flange.

* * * * *